US006793426B2

(12) United States Patent
Willat

(10) Patent No.: US 6,793,426 B2
(45) Date of Patent: Sep. 21, 2004

(54) DEFORMABLE GRIP WITH MOTION INDICATOR

(75) Inventor: Boyd I. Willat, Los Angeles, CA (US)

(73) Assignee: Sanford L.P., Bellwood, IL (US)

( * ) Notice: Subject to any disclaimer, the term of this patent is extended or adjusted under 35 U.S.C. 154(b) by 0 days.

(21) Appl. No.: 10/676,510

(22) Filed: Oct. 1, 2003

(65) Prior Publication Data

US 2004/0126175 A1 Jul. 1, 2004

Related U.S. Application Data

(60) Provisional application No. 60/415,133, filed on Oct. 2, 2002.

(51) Int. Cl.[7] ..... A46B 5/02
(52) U.S. Cl. ..... 401/6
(58) Field of Search ..... 401/6, 7, 48

(56) References Cited

U.S. PATENT DOCUMENTS

| | | | | |
|---|---|---|---|---|
| 141,287 | A | | 7/1873 | Orndorff |
| 255,961 | A | | 4/1882 | Faber |
| 412,479 | A | | 10/1889 | Davis |
| 544,990 | A | | 8/1895 | Miller |
| 624,853 | A | | 5/1899 | Oberbeck |
| 770,363 | A | | 9/1904 | Goldsmith |
| 782,388 | A | | 2/1905 | Goldsmith |
| 839,537 | A | | 12/1906 | Beaumel |
| 1,868,441 | A | | 7/1932 | Colfelt |
| 2,236,194 | A | | 3/1941 | Lorber |
| 3,269,399 | A | | 8/1966 | Smith |
| 3,863,271 | A | | 2/1975 | Moroney |
| 4,035,089 | A | | 7/1977 | Schwartz et al. |
| 4,044,625 | A | | 8/1977 | D'Haem et al. |
| 4,167,347 | A | | 9/1979 | Hoyle |
| 4,168,754 | A | | 9/1979 | Nyholm |
| 4,338,270 | A | | 7/1982 | Uffindell |
| 4,364,150 | A | | 12/1982 | Remington |
| 4,911,569 | A | * | 3/1990 | Hashimoto et al. ..... 401/55 |
| 4,934,024 | A | | 6/1990 | Sexton, I |
| 5,000,599 | A | | 3/1991 | McCall et al. |

(List continued on next page.)

FOREIGN PATENT DOCUMENTS

| | | |
|---|---|---|
| DE | 1511325 | 7/1969 |
| DE | 2157175 | 5/1973 |
| DE | 2162132 | 6/1973 |
| DE | 3406522 | 9/1985 |
| DE | 29721565 | 2/1998 |

OTHER PUBLICATIONS

Copy of International Search Report for International Patent Application No. PCT/US03/30926, dated Mar. 3, 2004, 6 pages.

*Primary Examiner*—Gregory L. Huson
*Assistant Examiner*—Huyen Le
(74) *Attorney, Agent, or Firm*—Marshall, Gerstein & Borun LLP

(57) ABSTRACT

A deformable grip is provided for a writing implement or the like, wherein the grip resiliently conforms to individualized anatomical contours and preferences thereby providing enhanced user comfort with reduced fatigue. The deformable grip includes a resilient transparent outer sleeve mounted for manual grasping during normal implement use, wherein this outer sleeve encloses at least one interior cavity containing a substantially transparent fluid filler material to provide the outer sleeve with a deformable tactile feel. At least one solid or non-fluid body such as a ball or the like is carried within the interior cavity substantially in suspension within the fluid filler material. This non-fluid body is externally visible through the transparent outer sleeve, and movably displaces in response to manual grasping of the implement to visually indicate and confirm shape deformation of the grip.

12 Claims, 2 Drawing Sheets

U.S. PATENT DOCUMENTS 5,050,289 A 9/1991 Uffindell
5,159,717 A 11/1992 Drew et al.
5,216,091 A 6/1993 Stern et al.
5,716,303 A 2/1998 Scatterday
5,970,581 A * 10/1999 Chadwick et al. ..... 16/421
D439,277 S 3/2001 Rosenbaum
6,447,190 B1 * 9/2002 Kwitek ..... 401/6
6,648,535 B2 * 11/2003 Ferrara, Jr. ..... 401/6

* cited by examiner

DEFORMABLE GRIP WITH MOTION INDICATOR

CROSS-REFERENCE TO RELATED APPLICATION

This application claims the benefit under 35 U.S.C. §119 (e) of U.S. provisional patent application Ser. No. 60/415,133 filed on Oct. 2, 2002, the disclosure of which is incorporated herein by reference.

BACKGROUND OF THE DISCLOSURE

This disclosure relates generally to improvements in writing implements and the like. More specifically, this disclosure relates to an improved deformable grip responsive to user fingertip pressure to assume a highly comfortable and low fatigue geometric configuration, and further including means for visually indicating and confirming shape deformation of the grip.

In relatively small manual implements such as writing instruments and the like, cushioned grip structures are known in the form of resilient elastomer sleeves and the like. In some designs, an outer resilient sleeve encloses an internal cavity which is filled with a flowable filler material such as a deformable putty or relatively viscous liquid or gel adapted to displace and thereby accommodate substantial shape deformation when the grip structure is manually grasped. See, for example, U.S. Pat. No. 5,000,599 and co-pending U.S. patent application Ser. No. 10/262,668, filed on Oct. 2, 2002. Such grip structures can undergo substantial shape deformation to conform closely to the anatomical contours of a particular user's hand and/or fingertips for enhanced user comfort. However, in grip structures of this type, while the user can detect deformation by tactile sensation, the user cannot visually see any indication that the flowable filler material has actually displaced within the internal sleeve cavity. It is believed that visual detection of filler material displacement will enhance user comfort and satisfaction.

An improved deformable grip is disclosed herein for use with small manual implements particularly such as a writing implement, wherein the improved deformable grip incorporates a flowable fluid-type filler material contained within an internal chamber or cavity defined by a resilient outer grip structure such as a sleeve, and further wherein the deformable grip includes means for visually indicating and confirming displacement of the filler material in response to manual grasping of the deformable grip.

SUMMARY OF THE DISCLOSURE

In accordance with the disclosure, an improved deformable grip is provided for use with a manually grasped implement such as a writing instrument or implement to provide a soft and resilient structure having the capacity for shape adaptation in conformance with the anatomical contours and particular grasping technique of an individual user. The deformable grip is designed to assume a custom fit configuration when the implement is grasped or gripped by the user for enhanced user comfort and control with reduced fatigue.

The deformable grip comprises an outer resilient and flexible grip. structure such as an outer resilient sleeve mounted on the implement, as by mounting onto an implement body or handle, to define and substantially enclose at least one interior chamber or cavity which is filled at least partially with a flowable resilient fluid-type filler material such as a liquid or gel in a quantity to provide the outer resilient sleeve with a selected and deformable tactile feel during normal use. In addition, at least one relatively small solid or non-fluid body such as a metal or plastic ball or other selected body shape is carried within the interior chamber or cavity substantially in suspension within the flowable filler material. This solid or non-fluid body is visible from the exterior of the manual implement by forming the outer resilient sleeve and the flowable filler material from transparent or partially transparent materials.

In use, when the outer resilient sleeve of the writing implement is manually grasped in a normal manner, tactile fingertip pressure applied to the sleeve causes the flowable filler material within the interior chamber or cavity to displace in a manner to accommodate a customized shape adaptation in conforming to the specific anatomical contours and particular grasping technique of an individual user. Such shape deformation of the outer sleeve is accompanied by movement of the solid or non-fluid body within the interior chamber or cavity, wherein such displacement is visually observable from the exterior of the implement through the transparent sleeve and flowable filler material. This movement of the solid or non-fluid body provides visual indication and confirmation of displacement of the flowable filler material and resultant shape deformation of the resilient sleeve.

Other features and advantages of the invention will become more apparent from the following detailed description, taken in conjunction with the accompanying drawings which illustrate, by way of example, the principles of the invention.

BRIEF DESCRIPTION OF THE DRAWINGS

The accompanying drawings illustrate the invention. In such drawings.

DETAILED DESCRIPTION

Figure 1:
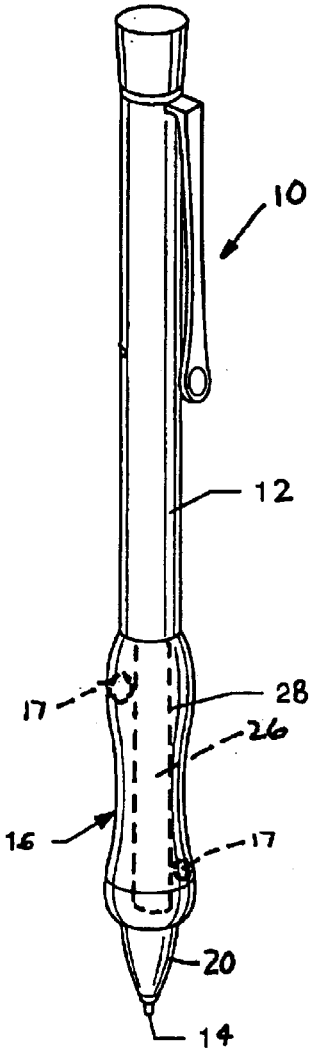
FIG. 1 is a perspective view illustrating a writing instrument or implement incorporating an improved deformable grip constructed in accordance with the present invention.

As shown in the exemplary drawings, a writing implement or instrument referred to generally in FIG. 1 by the reference numeral 10 includes an elongated implement body structure 12 with a marking medium such as an exposed ball point pen tip or nib 14 at one end thereof. A deformable grip 16 is provided on the implement body 12 at a position generally at or near the end adjacent the writing tip 14, at a position and location for manual grasping during normal implement use. The deformable grip 16 resiliently changes shape in response to manual or tactile pressure when grasped to conform geometrically to the anatomical contours of a particular user, resulting in an ergonomic grip configuration that significantly enhances user comfort and reduces user fatigue. The deformable grip 16 includes at least one motion indicator member that is internally mounted and externally visible. The motion indicator member may be a solid or non-fluid body 17 such as a pair of balls as shown in the illustrative drawings, to provide an externally visible indication and confirmation of shape deformation of the grip 16 during use.

The deformable grip 16 is shown in the exemplary drawings for use with the illustrative writing or marking implement 10 having a body or housing geometry suitable for manual grasping during normal use. The illustrative drawings show the deformable grip 16 mounted on the writing implement 10 at a location near the marking tip 14, in a position for conventional grasping and manipulation of the writing implement during normal use thereof. In general terms, the deformable grip 16 provides a cushioned structure which advantageously conforms when grasped to a customized or personalized shape fit.

As shown, the body 12 of the writing implement 10 has an elongated and generally cylindrical configuration with a hollow interior for receiving and supporting a marking medium 18 such as a standard ball point pen cartridge. The front end of the marking medium 18 protrudes through a nose piece 20 at one end of the implement body 12 and terminates in the exposed writing tip 14, such as a floating porous ball through which ink (not shown) can flow when applied to a writing surface (also not shown) such as paper or the like.

Figure 2:
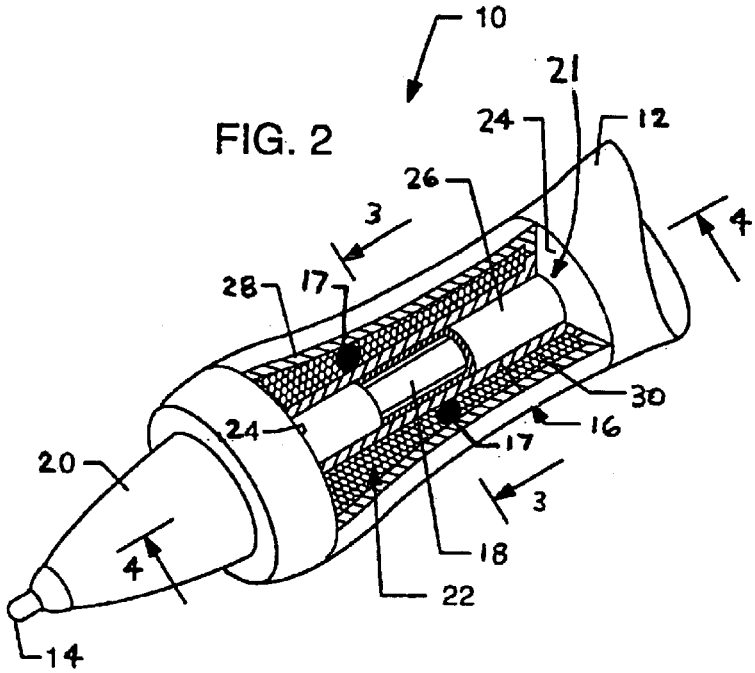
FIG. 2 is an enlarged fragmented perspective view of a portion of the writing implement of FIG. 1, with portions broken away to reveal construction details of the deformable grip and mounting thereof onto the writing implement.
Figure 3:
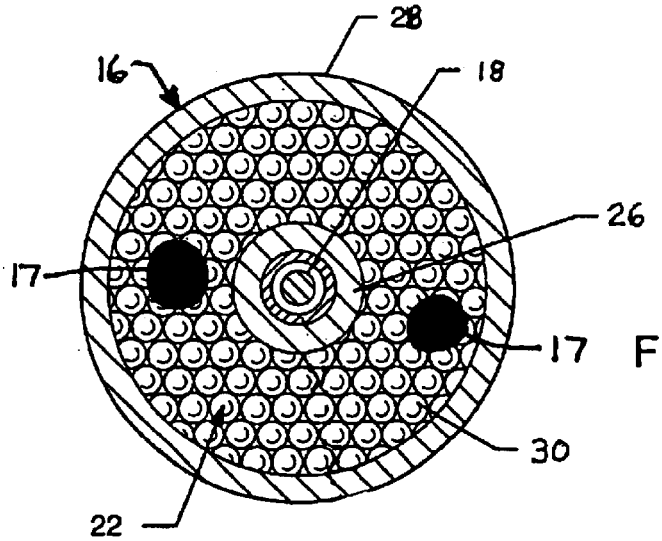
FIG. 3 is a transverse sectional view taken generally on the line 3—3 of FIG. 2.
Figure 4:
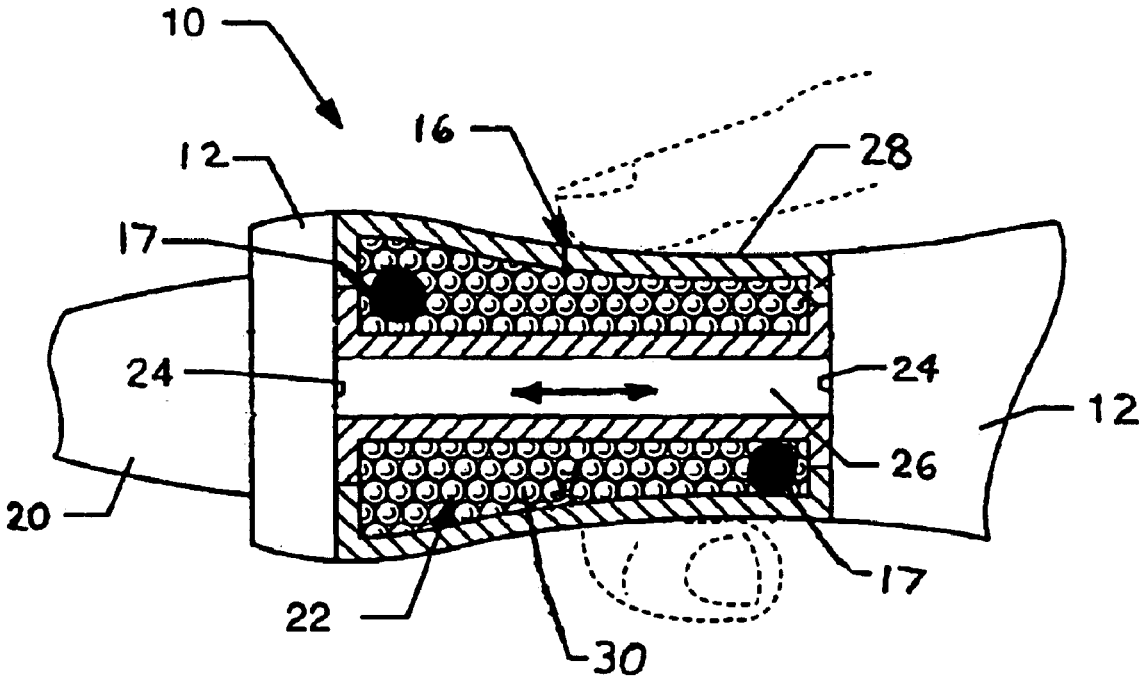
FIG. 4 is a transverse sectional view taken generally on the line 4—4 of FIG. 2, and illustrating fingertip pressure applied to the deformable grip during normal use of the writing implement.

As shown in more detail in FIGS. 2–4, the writing implement body 12 is shaped to include a generally annular recess 21 at a position at or near the nose piece 20. The recess 21 is normally defined between a pair of axially spaced shoulders 24 (FIG. 2) and surrounds a central guide tube 26 of reduced diameter through which the marking medium cartridge 18 extends. The axial length of the recess 21 may vary in accordance with the size and style of the writing implement, with a typical length on the order of about one to two inches being suitable for most writing implement applications.

The recess 21 is enclosed by an outer cylindrical sleeve 28 of a thin rubber-based or deformable plastic or other selected resilient and deformable elastomer material. The sleeve 28 has its opposite ends suitably attached at or to the opposed shoulder 24 at the opposite ends of the recess 21, for substantially enclosing the recess. A space between the outer cylindrical sleeve 28 and the central guide tube 26 defines an interior cavity 22 of the deformable grip. The outer sleeve 28 is formed to have a transparent or at least partially transparent construction, so that the interior cavity 22 may be externally viewed and observed, as will be described in more detail herein.

A flowable filler material 30 is provided within the interior cavity 22, to at least partially fill the cavity. In one form, this flowable filler material comprises a fluid-type substance such as a relatively viscous liquid or gel suitable for movably responding to fingertip or tactile pressure applied to the outer sleeve 28 during normal use of the manual implement. The flowable filler material may also be formed from material that is transparent or at least partially transparent.

In addition to the flowable filler material 30, at least one of the solid or non-fluid bodies 17 such as the pair of balls shown in the illustrative drawings are also contained within the interior cavity 22, to provide an externally visible indication and confirmation of shape deformation of the grip 16 during use. More particularly, the non-fluid ball or balls 17 each have a size and shape for placement into the interior cavity 22, substantially in suspension within the flowable filler material 30. Each ball 17 is visible from the exterior of the implement 10, by virtue of the transparent characteristics of the outer sleeve 28 and the filler material 30. When the implement 10 is not in use, the ball or balls 17 will tend to shift gravitationally within the interior cavity 22, thereby providing an externally visible indication that the ball or balls are suspended within a transparent substance, namely, the filler material 30.

When the implement 10 is manually grasped for normal use, as viewed in FIG. 4, the filler material 30 will movably displace within the interior cavity 22 to accommodate shape deformation of the outer sleeve 28 according to the custom anatomical contours of the user's fingertips or the like. Such shape deformation, due to the transparent character of the filler material 30 does not by itself indicate to the user that the filler material 30 has movably shifted within the interior cavity 22. However, such displacement of the filler material 30 is accompanied by movement or displacement of the ball or balls 17, whereby such ball movement provides an externally visible and observable indication and confirmation that the material 30 has undergone shape deformation.

Although the illustrated embodiment has been shown and described with respect to solid or non-fluid bodies 17 in the form of round balls, persons skilled in the art will recognize and appreciate that a wide variety of alternative shapes and other appearances may be used. For example, in certain applications, the solid or non-fluid body may comprise a novelty figure such as an animal or toy shape or the like, and further wherein the non-fluid body may be formed from a rigid incompressible or a soft deformable material. Bright colors may also be used to enhance the visibility thereof.

A variety of further modifications and improvements in and to the writing implement or instrument 10 having the deformable grip 16 of the present invention will be apparent to those persons skilled in the art. Accordingly, no limitation on the invention is intended by way of the foregoing description and accompanying drawings.

What is claimed is:

1. A writing implement, comprising:

an implement body carrying a marking medium at one end thereof;

a deformable grip on the implement body and defining an interior cavity having a deformable flowable filler material therein, the deformable grip movably responding to tactile pressure when the deformable grip is manually grasped;

the deformable grip and the flowable filler material being formed from an at least partially transparent material; and at least one motion indicator member disposed within the interior cavity, the motion indicator member being at least partially visible from the exterior of the interior cavity and movably responding within the interior cavity to manual grasping of the deformable grip.

2. The writing implement of claim 1, in which at least one motion indicator member comprises at least one solid body.

3. The writing implement of claim 2, in which the at least one solid body comprises a ball.

4. The writing implement of claim 2, in which the at least one solid body comprises a pair of balls.

5. The writing implement of claim 1, in which the at least one motion indicator member comprises at least one non-fluid body.

6. The writing implement of claim 1, in which the implement body defines a recess sized to receive the deformable grip.

7. The writing implement of claim 6, in which the deformable grip includes an outer cylindrical sleeve formed of resilient and at least partially transparent material attached to opposite ends of the implement body recess.

8. A writing implement, comprising:

an implement body carrying a marking medium at one end thereof and defining a recess adjacent the marking medium;

a deformable grip on the implement body including a cylindrical sleeve formed of resilient material and attached to opposite ends of the implement body recess, wherein a space between the cylindrical sleeve and the implement body recess defines an interior cavity, the deformable grip further including a deformable flowable filler material therein, the deformable grip movably responding to tactile pressure when the deformable grip is manually grasped;

the deformable grip and the flowable filler material being formed from an at least partially transparent material; and at least one motion indicator member disposed within the interior cavity, the motion indicator member being at least partially visible from the exterior of the interior cavity and movably responding within the interior cavity to manual grasping of the deformable grip.

9. The writing implement of claim 8, in which at least one motion indicator member comprises at least one solid body.

10. The writing implement of claim 9, in which the at least one solid body comprises a ball.

11. The writing implement of claim 9, in which the at least one solid body comprises a pair of balls.

12. The writing implement of claim 8, in which the at least one motion indicator member comprises at least one non-fluid body.

* * * * *